US012571611B2

(12) United States Patent
Mize et al.

(10) Patent No.: US 12,571,611 B2
(45) Date of Patent: Mar. 10, 2026

(54) METHOD AND SYSTEM FOR RAIL GRABBER WITH ATTENUATED MECHANICAL RESPONSE

(71) Applicant: DRS Network & Imaging Systems, LLC, Melbourne, FL (US)

(72) Inventors: Shawn Mize, Duncanville, TX (US); William Mapel, Liberty Hill, TX (US); Paul Williams, Austin, TX (US); Nick Jameson, Cedar Park, TX (US); Kenneth Pietrasik, Murphy, TX (US); Alan Rudnai, Austin, TX (US)

(73) Assignee: DRS Network & Imaging Systems, LLC, Melbourne, FL (US)

( * ) Notice: Subject to any disclaimer, the term of this patent is extended or adjusted under 35 U.S.C. 154(b) by 0 days.

(21) Appl. No.: 18/733,472

(22) Filed: Jun. 4, 2024

(65) Prior Publication Data

US 2024/0401911 A1 Dec. 5, 2024

Related U.S. Application Data

(60) Provisional application No. 63/506,190, filed on Jun. 5, 2023.

(51) Int. Cl.
*F41G 1/387* (2006.01)

(52) U.S. Cl.
CPC ..... *F41G 1/387* (2013.01)

(58) Field of Classification Search
CPC ..... F41G 1/387; F41G 1/393; F41G 11/002; F41G 11/003

(Continued)

(56) References Cited

U.S. PATENT DOCUMENTS 2,115,618 A * 4/1938 Carl ..... F41G 11/008 42/16
6,678,988 B1 * 1/2004 Poff, Jr. ..... F41G 11/003 42/147

(Continued)

FOREIGN PATENT DOCUMENTS

CN 112762764 A * 5/2021 ..... F41G 11/001
DE 102009035661 A1 * 2/2011 ..... F41G 11/002

(Continued)

OTHER PUBLICATIONS

DE102009035661A1 English Translation (Year: 2011).*
Application No. EP24179924.6 , Extended European Search Report, Mailed On Oct. 16, 2024, 11 pages.

*Primary Examiner* — Reginald S Tillman, Jr.
(74) *Attorney, Agent, or Firm* — Kilpatrick Townsend & Stockton LLP

(57) ABSTRACT

An attenuated rail grabber includes a rigid support member operable to be mounted on a weapon and support an optical device including a first fastener receiver and a second fastener receiver. The attenuated rail grabber includes a fastening mechanism coupled to the rigid support member and operable to fasten the rigid support member to the weapon. The attenuated rail grabber includes a first spring feature coupled to the rigid support member. The first spring feature includes a fore mounting tab having a fore fastener aperture. The attenuated rail grabber also includes a second spring feature coupled to the rigid support member. The second spring feature includes an aft mounting tab having an aft fastener aperture. The fore fastener aperture is operable to receive a first fastener joined to the first fastener receiver and the aft fastener aperture is operable to receive a second fastener joined to the second fastener receiver.

20 Claims, 8 Drawing Sheets

(58) Field of Classification Search
USPC ..... 42/1.06, 124–128
See application file for complete search history.

(56) References Cited

U.S. PATENT DOCUMENTS

| | | | | |
|---|---|---|---|---|
| 8,161,674 | B2 * | 4/2012 | Holmberg | F41C 27/00 42/124 |
| 9,267,753 | B2 * | 2/2016 | Dextraze | F41G 11/002 |
| 9,400,157 | B2 | 7/2016 | Pekarek et al. | |
| 9,759,523 | B2 | 9/2017 | Pekarek et al. | |
| 2009/0038201 | A1 | 2/2009 | Cheng et al. | |
| 2010/0275494 | A1 | 11/2010 | Chang et al. | |

FOREIGN PATENT DOCUMENTS

| | | | | |
|---|---|---|---|---|
| FR | 3016959 | A1 * | 7/2015 | F41G 11/002 |
| WO | 2022068843 | A1 | 4/2022 | |

* cited by examiner

METHOD AND SYSTEM FOR RAIL GRABBER WITH ATTENUATED MECHANICAL RESPONSE

CROSS-REFERENCES TO RELATED APPLICATIONS

This application claims priority to U.S. Provisional Application No. 63/506,190 filed on Jun. 5, 2023, the contents of which are incorporated by reference in their entirety for all purposes.

BACKGROUND OF THE INVENTION

The shock generated by a weapon such as a gun during gunfire may be severe. Therefore, any device being used with the weapon or otherwise connected to the weapon, such as an optical device, may be damaged upon use of the weapon due to that shock.

Therefore, there is a need in the art for improved methods and systems to isolate the device such that shock traveling from the weapon to the device is substantially attenuated.

SUMMARY OF THE INVENTION

The present invention relates generally to weapons systems, and more particularly, to a weapon system with an apparatus, such as an attenuated rail grabber, for absorbing shock from a weapon such as a gun to an optical device.

According to an embodiment of the present invention, an attenuated rail grabber is provided. The attenuated rail grabber includes a rigid support member operable to be mounted on a weapon and support an optical device including a first fastener receiver and a second fastener receiver. The attenuated rail grabber includes a fastening mechanism coupled to the rigid support member and operable to fasten the rigid support member to the weapon. The attenuated rail grabber also includes a first spring feature coupled to the rigid support member. The first spring feature includes a fore mounting tab having a fore fastener aperture. The attenuated rail grabber also includes a second spring feature coupled to the rigid support member. The second spring feature includes an aft mounting tab having an aft fastener aperture. The fore fastener aperture is operable to receive a first fastener joined to the first fastener receiver and the aft fastener aperture is operable to receive a second fastener joined to the second fastener receiver.

The attenuated rail grabber can include the rigid support member being positioned between the weapon and the optical device after mounting. The attenuated rail grabber can be disposed adjacent to the optical device. The attenuated rail grabber can include the attenuated rail grabber being disposed between the first spring feature and the second spring feature. The rigid support member can include a projection configured to align with a corresponding indentation on the weapon. The rigid support member, the first spring feature, and the second spring feature may be disposed in a plane. The plane can include a longitudinal axis of the weapon. The first spring feature and the second spring feature can allow for relative movement between the rigid support member and the weapon. The g load can be reduced from 1500 to 400 g's. The first spring feature may have a first shape and the second spring feature may have a second shape where the first shape and the second shape are different. The first spring feature may have a first shape and the second spring feature may have a second shape where the first shape and the second shape are the same.

According to another embodiment, an attenuated rail grabber is provided. The attenuated rail grabber is operable with a weapon and an optical device. The attenuated rail grabber includes a weapon support configured to couple to an accessory rail of the weapon. The attenuated rail grabber includes a first spring feature extending from the weapon support and configured to couple to the optical device. The attenuated rail grabber includes a second spring feature extending from the weapon support and configured to couple to the optical device. The attenuated rail grabber is configured to reduce shock experienced by the optical device by a predetermined g load.

The attenuated rail grabber can include the weapon support being positioned between the weapon and the optical device after mounting. The attenuated rail grabber can be disposed adjacent to the optical device. The weapon support can be disposed between the first spring feature and the second spring feature. The weapon support can include a projection configured to align with a corresponding indentation on the weapon. The weapon support, the first spring feature, and the second spring feature can be disposed in a plane. The plane can include a longitudinal axis of the weapon. The first spring feature and the second spring feature can allow for relative movement between the weapon support and the weapon. The g load experienced by the optical device may be reduced from 1500 to 400 g's.

Numerous benefits are achieved by way of embodiments of the present invention over conventional techniques. For example, embodiments of the present invention provide an attenuated rail grabber that reduces shock experienced by an optical device, or another device attached to the attenuated rail grabber, during operation of a weapon to acceptable levels. The attenuated rail grabber as described herein provides shock attenuation, for example, from 1500 to 400 g's. The attenuated rail grabber can protect the functionality of the device by attenuating its exposure to shock from the weapon. Furthermore, the attenuated rail grabber may be lightweight, durable/strong, compact, and allow the weapon system to maintain acceptable boresight. In various embodiments, the attenuated rail grabber as described throughout the present disclosure is able to attenuate at least a portion of the weapon shock without adding any additional height to the system. Maintaining the height of the system enables backwards compatibility with industry standard optics and telescopic sights. The design of the presently disclosed attenuated rail grabber filters out low and high frequencies, thereby increasing reliability and decreasing wear of the mounted system. These and other embodiments of the invention along with many of its advantages and features are described in more detail in conjunction with the text below and attached figures.

BRIEF DESCRIPTION OF THE DRAWINGS

Embodiments of the present invention are described below with reference to the attached drawings, in which.

DETAILED DESCRIPTION OF THE INVENTION

According to embodiments of the present invention, an apparatus related to weapon systems is provided. More particularly, embodiments of the present invention relate to a weapon system with an apparatus, such as an attenuated rail grabber, for absorbing shock that would otherwise travel from a weapon such as a gun (e.g., a rifle) to an optical device. The attenuated rail grabber (or "attenuator" herein) can be mounted, for example, between a sniper rifle and an optical device. The attenuated rail grabber can reduce the shock experienced by the optical device when operated on a weapon, for example, from 1500 to 400 g's. The attenuated rail grabber design and composition can be optimized to reduce or minimize the shock felt by the optical device. The attenuated rail grabber can protect the functionality of the optical device by isolating the optical device from the rifle to attenuate the shock exposure of the optical device. The attenuated rail grabber can be lightweight, compact, and allow the weapon to maintain its lightweight feel while remaining durable and maintaining acceptable boresight.

In various embodiments, the components of the attenuated rail grabber are in a same plane as a longitudinal axis of a weapon. Advantageously, having spring features of the attenuated rail grabber and the rigid support member of the attenuated rail grabber in the same plane reduces stacking of tolerances, thereby increasing boresight retention (e.g., allowing relatively quick returns to boresight). Furthermore, the compactness of the attenuated rail grabber allows the weapon system to maintain acceptable boresight with respect to industry standard optics and telescopic sights.

Embodiments of the present invention, along with many of their advantages and features, are described in more detail in conjunction with the text below and its related figures.

Figure 1:
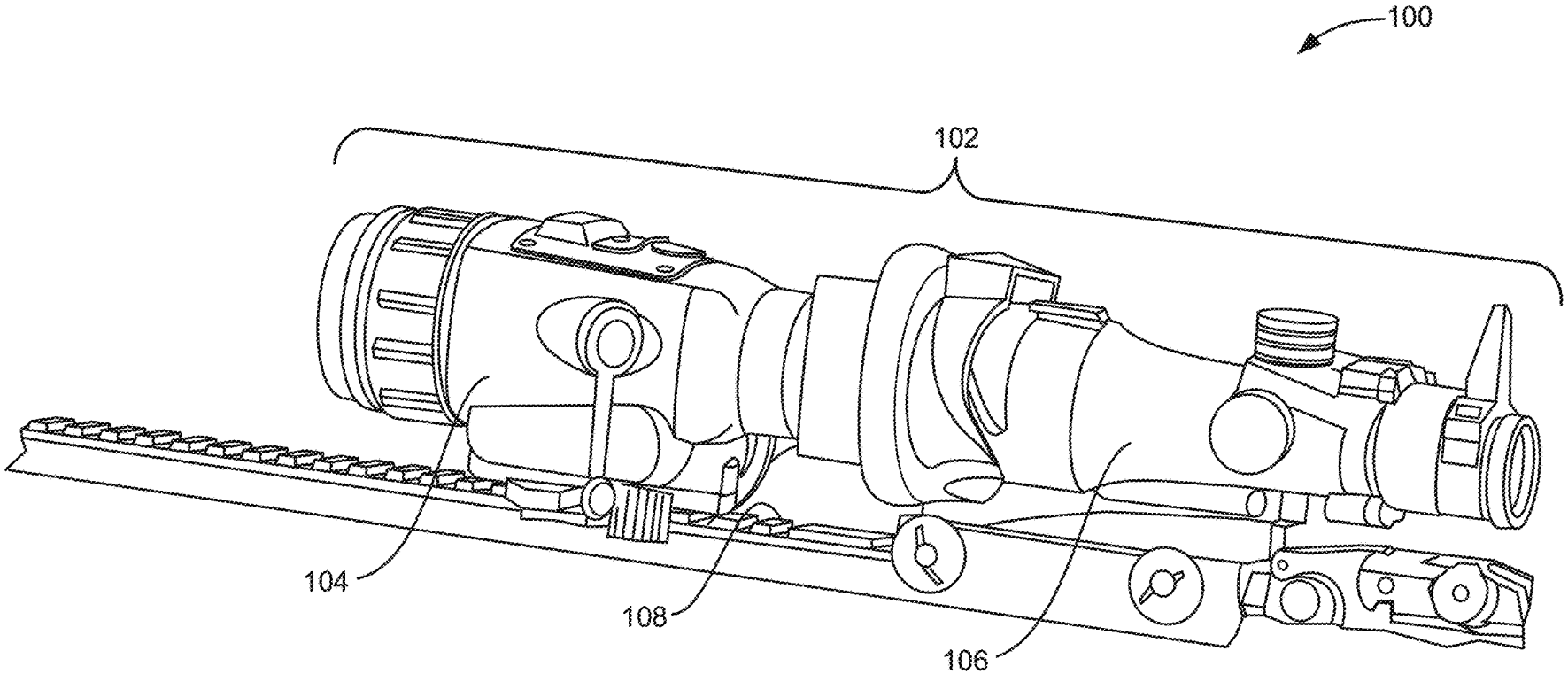
FIG. 1 illustrates a system that includes an optical device and an accessory rail, according to embodiments of the present invention.

FIG. 1 illustrates a system that includes an optical device and an accessory rail, according to embodiments of the present invention. FIG. 1 shows a system 100 that includes an optical device 102 and an accessory rail 108, according to embodiments of the present invention. Optical device 102 includes night vision sight 104 and an optical telescopic sight 106. For example, the optical device 102 including the night vision sight 104 may be used in a stand-alone configuration, as would be appreciated by one having ordinary skill in the art. Optical telescopic sight 106 is a sighting device, based on a telescope, that may be attached to the top of a weapon, such as a rifle, to allow the user of the rifle to view a magnified image of its target. Night vision sight 104 allows a user to utilize the optical telescopic sight 106 when located in a dark environment. Optical device 102 is configured to couple to a weapon, such as a rifle, via an accessory rail or other connecting device that is attached to the weapon, such as accessory rail 108. Accessory rail 108 provides a mounting platform for accessories and attachments, such as optical device 102.

Although optical device 102 includes night vision sight 104 and optical telescopic sight 106 in FIG. 1, a variety of other sights or combinations of sights could be used in conjunction with embodiments of the present invention. For example, possible optical devices may include a night vision rifle scope, an open sight, an aperture sight, a red dot sight, a laser sight, a "clip-on" style sight with an actively cooled detector, an objective lens assembly (OLA), an eyepiece assembly, electronic boards and interconnect, a combination of these sights, or other various optical devices on the market.

Since an optical device is generally directly connected to an accessory rail of the weapon, the optical device may experience shock that travels from the weapon to the optical device through the accessory rail when the weapon is fired. Such shock may be severe. Such shock may cause damage to the expensive components of the optical device. Thus, according to embodiments of the present invention, a shock attenuator may be placed in between the weapon and optical device to isolate the optical device from the weapon and attenuate a portion of the shock traveling from the weapon to the optical device. It should be appreciated by one having ordinary skill in the art that various embodiments of the present disclosure may be used with non-optical devices mounted to a weapon to attenuate a shock experienced by a non-optical device.

Figure 2:
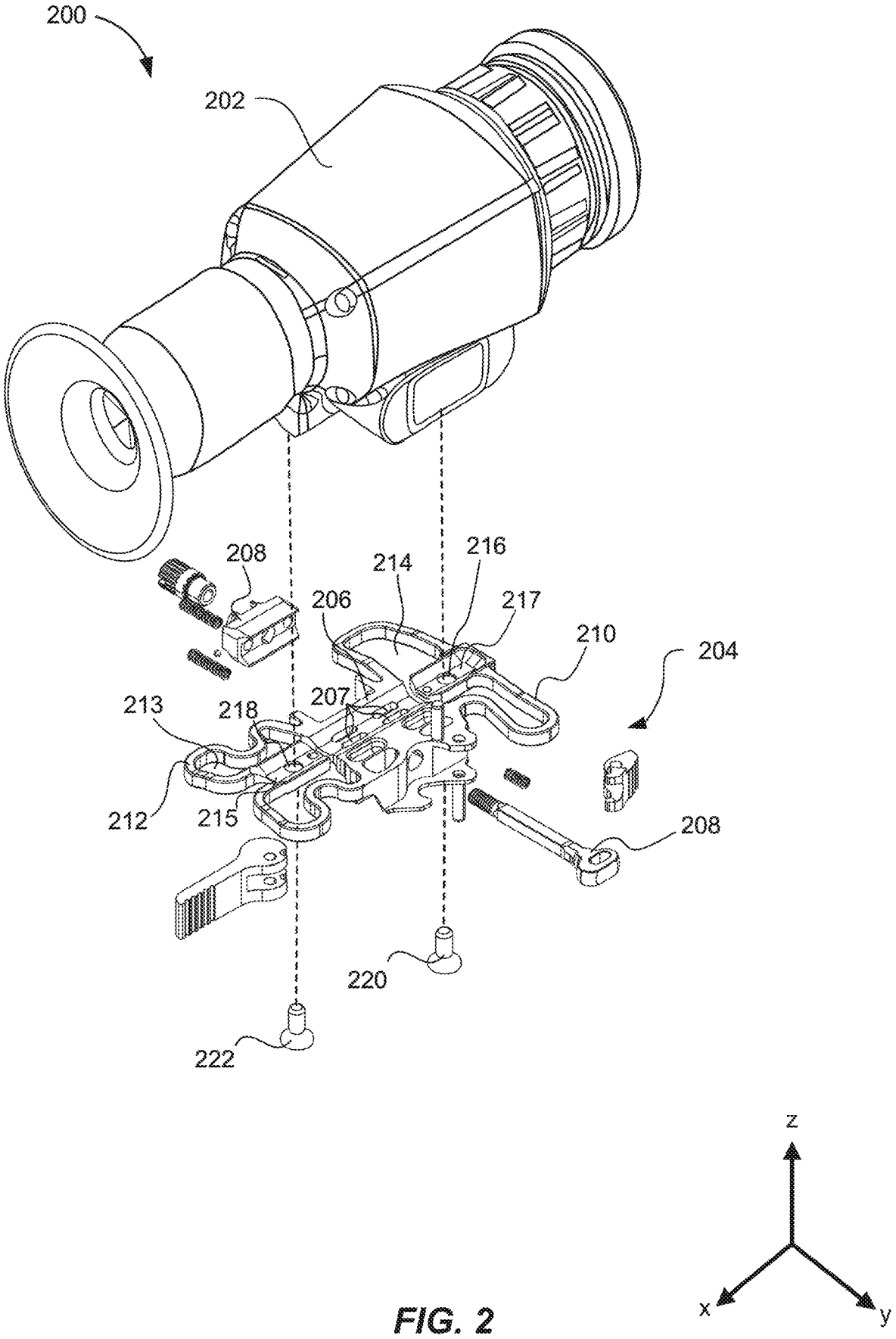
FIG. 2 illustrates a system that includes an optical device and an attenuated rail grabber, according to embodiments of the present invention.

FIG. 2 is a perspective view of an optical device and an attenuated rail grabber according to an embodiment of the present invention. As illustrated in FIG. 2, a system that includes an optical device and an attenuated rail grabber is provided. The optical device 202 and attenuated rail grabber 204 can be removably coupled together to form a system 200. FIG. 2 shows an optical device 202 as it would be situated when connected to accessory rail 108 illustrated in FIG. 1. The accessory rail 108 illustrated in FIG. 1 is typically attached to a weapon, for example, a gun. Thus, the attenuated rail grabber 204 can be utilized to couple an accessory, such as the optical device 202, to a weapon, for example, to an accessory rail mounted on a weapon.

As shown in FIG. 2, attenuated rail grabber 204 can be mounted between the optical device 202 (including any sight configured to be used with the attenuated rail grabber 204) and a weapon or an accessory rail of a weapon. For example, the attenuated rail grabber 204 may be mounted to an accessory rail of a weapon as shown and described throughout the present disclosure. In another example, an accessory rail may be integrally formed with the weapon and the attenuated rail grabber 204 may be mounted to the weapon. In at least some embodiments, the weapon is a gun. In various embodiments, the attenuated rail grabber 204 is disposed adjacent to the optical device 202 (e.g., the attenuated rail grabber 204 is configured to be positioned between the optical device 202 and a weapon or an accessory rail of the weapon). The attenuated rail grabber 204 is mounted between the optical device 202 and the weapon or the accessory rail of the weapon to physically isolate the optical device 202 from the weapon or the accessory rail of the weapon to which the weapon is connected and to attenuate a portion of the shock traveling from the weapon to the optical device 202. The attenuated rail grabber 204 may be configured to attenuate the shock to the optical device 202 by a predetermined g load during operation. For example, the predetermined g load may be reduced from 1500 to 400 g's.

The attenuated rail grabber 204 includes a rigid support member 206 (e.g., a weapon support) operable to be mounted on a weapon (e.g., the weapon or the accessory rail of the weapon) and support the optical device 202. The rigid support member 206 is positioned between the weapon and the optical device 202 after mounting. For example, as discussed more fully herein, the optical device 202 may be mounted to mounting tabs of the attenuated rail grabber 204 and the combined optical device 202 and the attenuated rail grabber 204 may be mounted to the accessory rail of the weapon or the weapon by attaching the rigid support member 206 to the accessory rail of the weapon or to the weapon such that it is disposed between the weapon and the optical device 202.

In various embodiments, the rigid support member 206 includes lightening features 207 (e.g., holes or openings) to reduce the overall weight and mass of the attenuated rail grabber 204. The lightening features 207 further alter the resonance frequency of the attenuated rail grabber 204. Lightening features 207 reduce the overall weight of the attenuated rail grabber 204 so that when the attenuated rail grabber 204 is added to the weapon and optical device system, the least amount of weight is added to the system while providing substantial shock attenuation, for example, from 1500 to 400 g's.

In at least some embodiments, the rigid support member 206 includes projections (not shown) on the weapon. The projections do not securely couple to corresponding indentations on the accessory rail of the weapon or to the weapon. Rather, the projections may be surrounded by and loosely encompassed by the corresponding indentations, thereby allowing slight relative movement between the rigid support member 206 and the accessory rail of the weapon or the weapon. In another embodiment, the projections of the rigid support member 206 securely couple to corresponding indentations of the accessory rail of the weapon or the weapon and do not allow relative movement between the rigid support member 206 and the accessory rail of the weapon or the weapon.

The attenuated rail grabber 204 includes a fastening mechanism 208 coupled to the rigid support member 206 and operable to fasten the rigid support member 206 to the weapon. In one embodiment, the fastening mechanism 208 includes a multi-part latching mechanism, as shown in FIG. 2. In various embodiments, the fastening mechanism 208 may include any fastening mechanism known in the art including a cam latch, a compression latch, a draw latch, or the like. In other embodiments, the fastening mechanism 208 includes magnetic or electronic fastening mechanisms.

The attenuated rail grabber 204 includes a first spring feature 210 coupled to the rigid support member 206 and a second spring feature 212 coupled to the rigid support member 206. In various embodiments, the rigid support member 206, the first spring feature 210, and the second spring feature 212 are a continuous, integrated piece. In various embodiments, the first spring feature 210 and the second spring feature 212 are located on opposite ends of the rigid support member 206. As illustrated in FIG. 2, the first spring feature 210 extends forward from the rigid support member 206 and can be referred to as a fore spring feature and the second spring feature 212 extends backward from the rigid support member 206 and can be referred to as an aft spring feature. Thus, the rigid support member 206 is disposed between the first spring feature 210 and the second spring feature 212. For example, the rigid support member 206, the first spring feature 210, and the second spring feature 212 are disposed in a plane (i.e., the x-y plane). The plane may include a longitudinal axis (i.e., the x-axis) of the weapon, e.g., the weapon may be longer than it is wide, and the longitudinal axis may be aligned with the longer dimension of the weapon. In particular, a flat topmost surface of each of the rigid support member 206, the first spring feature 210, and the second spring feature 212 are aligned in the same plane (i.e., a plane defined at a predetermined z-position). Advantageously, having the first spring feature 210, the second spring feature 212, and the rigid support member 206 in the same plane reduces stacking tolerances, thereby increasing boresight retention (e.g., allowing relatively quick returns to boresight). For example, various embodiments of the attenuated rail grabber described throughout the present disclosure are able to absorb substantially all of the vibrations generated by operation of the weapon within about 80 ms to about 100 ms from the time that the shock is generated.

The first spring feature 210 may extend from the rigid support member 206 and is configured to couple to the optical device 202. In at least some embodiments, and as shown in FIG. 2, the first spring feature 210 extends from a fore mounting tab 217 that can be referred to as a first mounting tab. The fore mounting tab 217 may provide a minimum amount of material to secure the attenuated rail grabber 204 to the optical device. For example, the fore mounting tab 217 includes a sufficient amount of material for a fore fastener aperture 216, to be described in further detail below, but does not significantly add to the weight of the attenuated rail grabber 204. Similarly, the second spring feature 212 may extend from the rigid support member 206 and is configured to couple to the optical device 202. In at least some embodiments, and as shown in FIG. 2, the second spring feature 212 extends from an aft mounting tab 215 that can be referred to as second mounting tab.

In some embodiments, the first spring feature 210 has a first shape and the second spring feature 212 has a second shape where each shape is a geometry defined in the x-y plane. For example, and as shown in FIG. 2, the first spring feature 210 has a first shape where the geometry is wider in the y-direction than in the x-direction. Furthermore, the geometry in the y-direction is also wider than the second shape's geometry in the y-direction. In contrast, as shown in FIG. 2, the second spring feature 212 has a second shape that is longer in the x-direction than the first shape's geometry in the x-direction. In some embodiments, the first shape and the second shape are different, as shown in FIG. 2. In other embodiments, the first shape and the second shape are the same. For example, the first shape and the second shape may be mirrored on opposing sides of the rigid support member 206.

The first spring feature 210 defines a first opening 214 that enables relative movement between rigid support member 206 and fore mounting tab 217. The second spring feature 212 defines a second opening 213 that enables relative movement between the rigid support member 206 and the aft mounting tab 215. Thus, rigid support member 206 is separated from the fore mounting tab 217 and the aft mounting tab 215 by the first spring feature 210 and second spring feature 212, respectively, allowing rigid support member 206, that can be attached to a weapon via fastening mechanism 208, to be physically separated from and not make physical contact with optical device 202. The first opening 214 and the second opening 213 allow for the first spring feature 210 and the second spring feature 212 to move toward and away from the rigid support member 206 when a shock or vibration is received at the attenuated rail grabber 204. In other words, the first opening 214 and the second opening 213 allow for the optical device 202 coupled to the first spring feature 210 and the second spring feature 212 to be substantially or fully isolated from the rigid support member 206 (and any weapon connected to the attenuated rail grabber 204). The first spring feature 210 and the second spring feature 212 substantially isolate the weapon from the optical device 202. For example, the first spring feature 210 and the second spring feature 212 (e.g., the fore mounting tab 217 and the aft mounting tab 215) are directly fastened to the optical device 202 and the rigid support member 206 is directly fastened to the weapon such that any shock, vibrations, or other signals traveling through the first spring feature 210 and the second spring feature 212 may/should not reach the optical device 202 (and any that does reach the first spring feature 210 and the second spring feature 212 would be minimal and would not significantly damage any optical device 202 connected to the attenuated rail grabber 204). The first spring feature 210 and the second spring feature 212 allow for slight movement with respect to each other so as to reduce shock transferred between the weapon and the optical device 202 attached to the attenuated rail grabber 204. The first spring feature 210 and the second spring feature 212 reduce the shock experienced by the optical device 202 during operation of a weapon and attenuating the g load from 1500 to 400 g's.

In various embodiments, the fore mounting tab 217 of the first spring feature 210 includes a fore fastener aperture 216 and the aft mounting tab 215 of the second spring feature 212 includes an aft fastener aperture 218. The fore fastener aperture 216 and the aft fastener aperture 218 are shown in FIG. 2 as holes or orifices passing through the attenuated rail grabber 204. Fore fastener aperture 216 is positioned adjacent the front of optical device 202 at a position characterized by a first distance along the x-axis and aft fastener aperture 218 is positioned adjacent the rear of optical device 202 at a positioned along the x-axis at a second distance less than the first distance, according to at least some embodiments.

The optical device 202 includes a first fastener receiver and a second fastener receiver (not shown) that correspond to the fore fastener aperture 216 and the aft fastener aperture 218. The fore fastener aperture 216, the aft fastener aperture 218, the first fastener receiver, and the second fastener receiver are each configured to fit into or around one another such that a set of screws could protrude through the apertures and receivers. The fore fastener aperture 216 is operable to receive a first fastener 220 joined to the first fastener receiver of the optical device 202. Similarly, the aft fastener aperture 218 is operable to receive a second fastener 222 joined to the second fastener receiver of the optical device 202. Accordingly, the first fastener 220 and the second fastener 222 are configured to couple the fore mounting tab 217 and the aft mounting tab 215 of the first spring feature 210 and the second spring feature 212 to the optical device 202. In at least some embodiments, the optical device 202 is coupled to the attenuated rail grabber 204 (e.g., the first spring feature 210 and the second spring feature 212) via the first fastener 220 and the second fastener 222 such that the rigid support member 206 does not contact the optical device 202. Although one specific embodiment of the fastener apertures and fastener receivers is shown, various other methods of coupling/fastening the optical device 202 to the attenuated rail grabber 204 are possible and understood to be within the scope of the present technology. Furthermore, FIGS. 2-5D show embodiments with specific shapes and configurations of an attenuated rail grabber. Various different shapes and configurations of the attenuated rail grabber may be used.

Figure 3A:
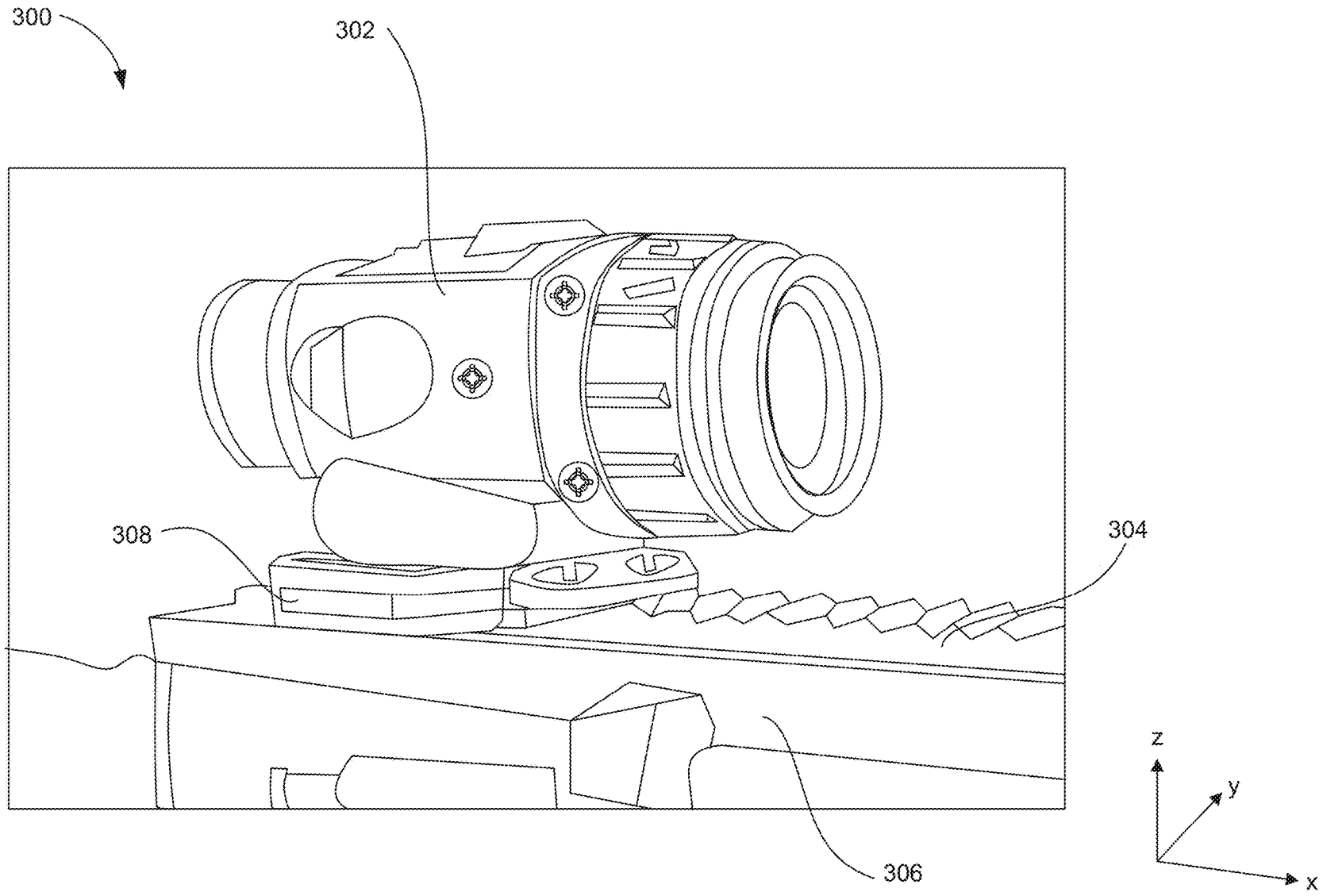
FIG. 3A illustrates a weapon system that includes an optical device, an attenuated rail grabber, and a weapon having an accessory rail, according to embodiments of the present invention.

FIG. 3A illustrates a weapon system that includes an optical device, an attenuated rail grabber, and a weapon having an accessory rail, according to embodiments of the present invention. As shown in FIG. 3A, the weapon system 300 includes an optical device 302 and an accessory rail 304 of a weapon 306, according to embodiments of the present invention. The attenuated rail grabber 308 (such as attenuated rail grabber 204 described in detail above with respect to FIG. 2) is disposed between the optical device 302 and the accessory rail 304 of the weapon 306. Each component of the attenuated rail grabber 308 is in the same plane 301 illustrated in FIG. 3B, e.g., determined by a predetermined z-position, including a longitudinal axis of the weapon 306. For example, a fore mounting tab, a first spring feature, an aft mounting tab, a second spring feature, and a rigid support member of the attenuated rail grabber 308 are disposed in the same plane 301 such that a topmost, relatively planar surface of each component is parallel along the same plane 301. In various embodiments, the components of the attenuated rail grabber 308 are in a same plane 301 as a longitudinal axis of a weapon for reducing stacking of tolerances, thereby increasing boresight retention (e.g., allowing relatively quick returns to boresight).

Furthermore, the compactness of the attenuated rail grabber 308 allows the weapon system to maintain acceptable alignment or boresight with respect to the optical device. In various embodiments described herein, having a fore mounting tab, a first spring feature, an aft mounting tab, a second spring feature, and a rigid support member of the attenuated rail grabber 308 in the same plane provides a low-profile attenuated rail grabber system for low and high frequency shock attenuation. Accordingly, the attenuated rail grabber, such as any of the embodiments of the attenuated rail grabber described herein, does not add additional height to the weapon/optical device system while improving the device system reliability and returning to the working boresight range.

Figure 3B:
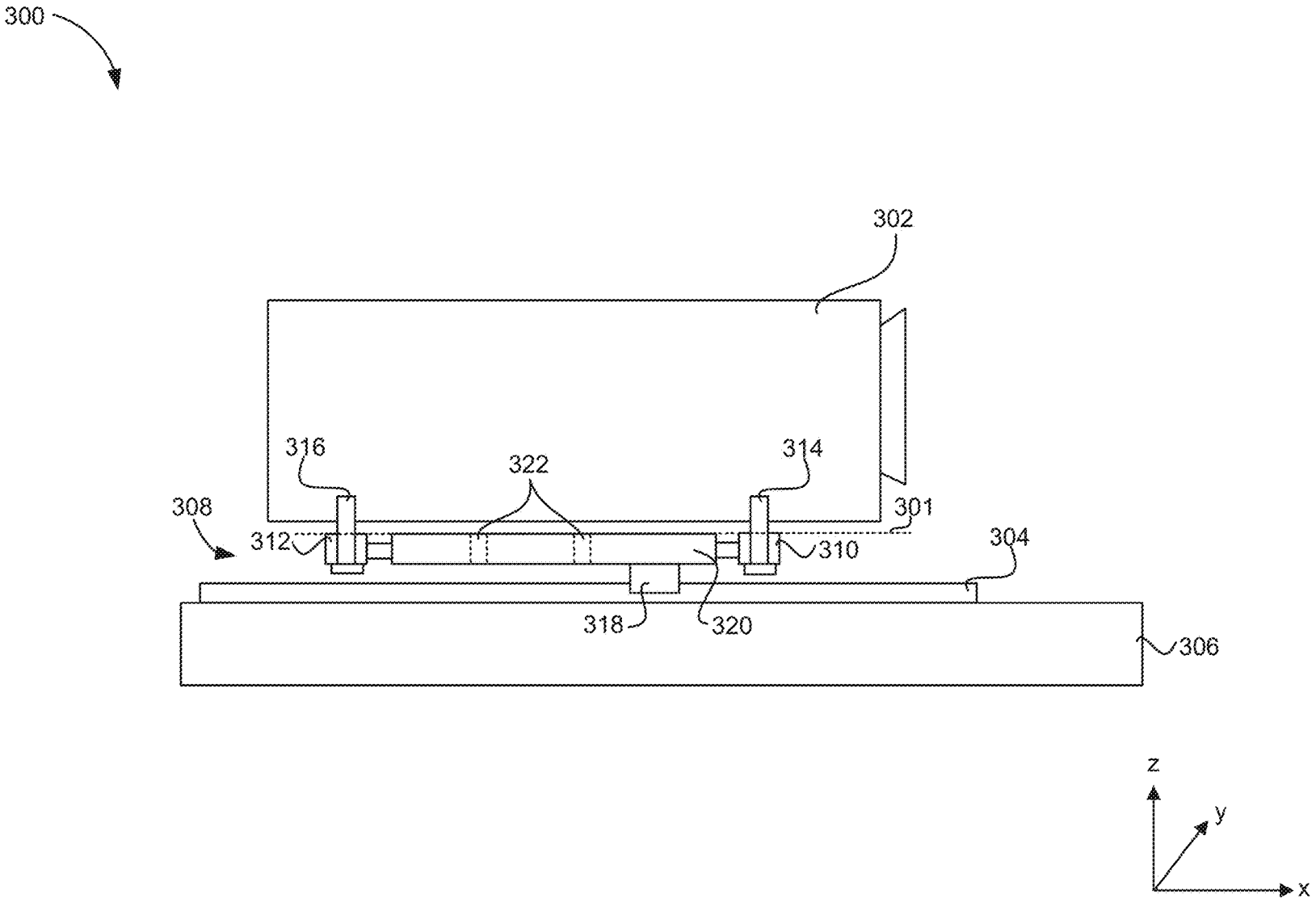
FIG. 3B illustrates a cross-section of a weapon system that includes an optical device, an attenuated rail grabber, and a weapon having an accessory rail, according to embodiments of the present invention.

FIG. 3B illustrates a cross-section of a weapon system that includes an optical device, an attenuated rail grabber, and a weapon having an accessory rail, according to embodiments of the present invention. As shown in FIG. 3B, attenuated rail grabber 308 can be mounted between the optical device 302 (including any sight configured to be used with the attenuated rail grabber 308) and an accessory rail 304 of a weapon 306. The accessory rail 304 may be removably coupled to the weapon 306 in some embodiments. In other embodiments, the accessory rail 304 is integrally formed as part of the weapon 306 and the attenuated rail grabber 308 is mounted to between the optical device 302 and the weapon 306. The attenuated rail grabber 308 is disposed adjacent to the optical device 302 such that the attenuated rail grabber 308 is configured to be disposed between the optical device 302 and the weapon 306 or the accessory rail 304 of the weapon. The attenuated rail grabber 308 is mounted between the optical device 302 and the weapon 306 or the accessory rail 304 of the weapon 306 to physically isolate the optical device 302 from the weapon 306 and to attenuate a portion of the shock traveling to the optical device 302 from the weapon 306. As shown, the optical device 302 is removably secured to a fore mounting tab 310 and an aft mounting tab 312 of the attenuated rail grabber via a first fastener 314 and a second fastener 316, respectively. In one example, the first fastener 314 and the second fastener 316 are screws with male mating surfaces that extend through and mate with female mating surfaces in apertures of the fore mounting tab 310 and the aft mounting tab 312, respectively. The first fastener 314 and the second fastener 316 extend through the fore mounting tab 310 and the aft mounting tab 312 such that the first fastener 314, the second fastener 316, the fore mounting tab 310, and the aft mounting tab 312 are the only components of the attenuated rail grabber 308 that contact the optical device 302. In particular, as shown, the first fastener 314, the second fastener 316, the fore mounting tab 310, and the aft mounting tab 312 hover above the accessory rail 304 of the weapon 306. This air gap between the first fastener 314, the second fastener 316, the fore mounting tab 310, and the aft mounting tab 312 and the accessory rail 304 of the weapon 306 decreases wear to the various components of the system. For example, less wear is experienced in the components of the system where the components do not rub against each other during operation of the weapon.

According to various embodiments and as illustrated by FIG. 3B, the attenuated rail grabber 308 includes a projection 318 that extends from a rigid support member 320 (e.g., a weapon support) positioned between the weapon 306 and the optical device 302. The attenuated rail grabber 308 may include one or more projections. In some embodiments, the projection 318 does not securely couple to a corresponding indentation on the accessory rail of the weapon and/or the weapon. Rather, the projection 318 may be surrounded by and be loosely encompassed by a corresponding indentation, thereby allowing slight relative movement between the rigid support member 320 and the accessory rail 304 of the weapon 306 or the weapon 306. In another embodiment, the projection 318 of the rigid support member 320 securely couples to a corresponding indentation of the accessory rail 304 of the weapon 306 or the weapon 306 and does not allow relative movement between the rigid support member 320 and the accessory rail 304 of the weapon 306 or the weapon 306.

As further shown in FIG. 3B, cross-sections of lightening features 322 are illustrated. Lightening features 322 (e.g., holes or openings) are used to reduce the overall weight and mass of the attenuated rail grabber 308. Lightening features 322 reduce the overall weight of the attenuated rail grabber 308 so that when the attenuated rail grabber 308 is added to the weapon system 300 including the optical device 302, the least amount of weight is added to the weapon system 300 while still reducing the shock received by the optical device 302 for example from 1500 to 400 g's.

Figure 4:
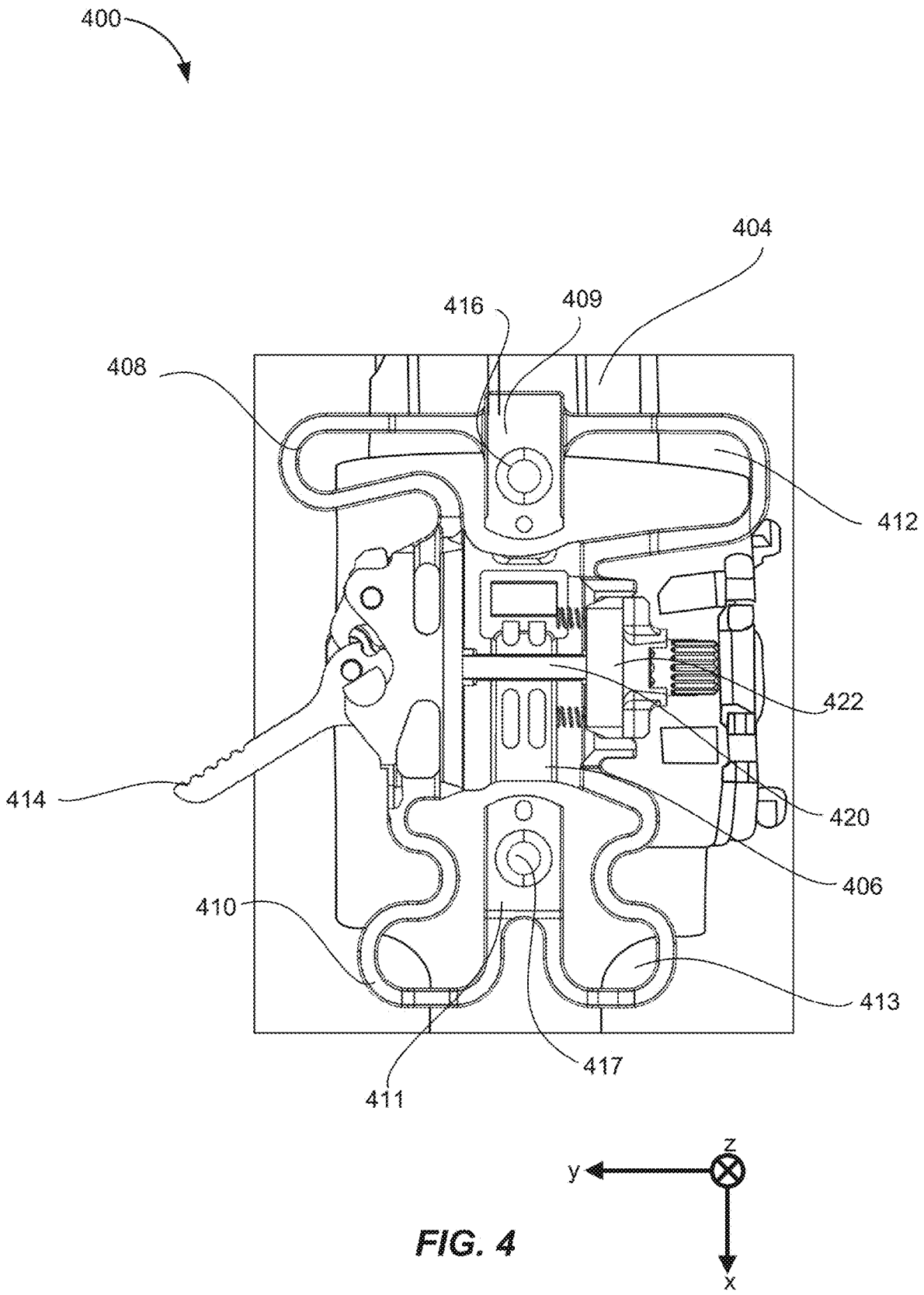
FIG. 4 illustrates an exemplary optical device situated upside down and coupled to an attenuated rail grabber, according to embodiments of the present invention.

FIG. 4 illustrates an exemplary optical device situated upside down and coupled to an attenuated rail grabber, according to embodiments of the present invention. In the embodiment illustrated in FIG. 4, the attenuated rail grabber 400 is coupled to an optical device 404. As shown, the attenuated rail grabber 400 includes a rigid support member 406 and a first spring feature 408 extending from the rigid support member 406 in the forward direction. First spring feature 408 includes a fore mounting tab 409 that is in physical contact with the optical device 404 at a location adjacent the front of the optical device 404. The attenuated rail grabber 400 also includes a second spring feature 410 extending from the rigid support member 406 in the aft direction. Second spring feature 410 includes an aft mounting tab 411 that is in physical contact with the optical device 404 at a location adjacent the rear of the optical device 404. The first spring feature 408 defines opening 412 that enables relative movement between rigid support member 406 and fore mounting tab 409. The second spring feature 410 defines opening 413 that enables relative movement between the rigid support member 406 and the aft mounting tab 411. Thus, rigid support member 406 is separated from fore mounting tab 409 and aft mounting tab 411 by first spring feature 408 and second spring feature 410, respectively, allowing rigid support member 406, that can be attached to a weapon via fastening mechanism 414, to be physically separated from and not make physical contact with optical device 404.

According to exemplary embodiments and as shown in FIG. 4, the fastening mechanism 414 may include a lever and cam design for keeping a tension rod 420 "square" during engagement, thereby improving boresight repeatability. For example, the tension rod 420 remains in position relative to the rigid support member 406 and the tension rod 420 does not rotate during installation. In at least some embodiments, the fastening mechanism 414 further includes a sliding block 422 that is captured by corresponding surfaces of an accessory rail of a weapon to maintain boresight alignment (e.g., such an accessory rail 304 of a weapon 306 as shown at least in FIGS. 3A and 3B). The sliding block 422 is sized and shaped to enable vertical movement of the rigid support member 406. Further, the sliding block 422 may be sized and shaped such that the attenuated rail grabber 400 may be adapted to variable rail sizes. The sliding block 422 may include a 45 degree sloping surface such that the sliding block 422 may wedge against one or more corresponding surfaces of an accessory rail of a weapon and/or one or more surfaces of the weapon.

As noted, since an optical device is generally directly connected to an accessory rail of the weapon, the optical device may experience severe shock that travels from the weapon to the optical device through the accessory rail when the weapon is fired, that could result in damage to the optical device. Although first spring feature 408 and second spring feature 410 may be in direct contact with both the optical device 404 and the weapon at different points along first spring feature 408 and second spring feature 410, such connections are separated by such a physical distance such that any shock, vibrations, or other signals traveling from the weapon through the first spring feature 408 and second spring feature 410 are greatly reduced before reaching the optical device 404. First spring feature 408 and second spring feature 410 enable shock waves, which would otherwise be transferred from the weapon to which the attenuated rail grabber 400 is mounted to optical device 404, to be attenuated prior to reaching the optical device 404. Since first spring feature 408 and second spring feature 410 will dampen vibrations and shock waves present at rigid support member 406, such vibrations and shock waves will be attenuated before they can be transferred from the weapon attached to rigid support member 406 to the optical device 404 attached to the fore mounting tab 409 and the aft mounting tab 411.

In various embodiments, the optical device 404 is removably coupled to the first spring feature 408 and the second spring feature 410 using fore fastener 416 and aft fastener 417 that extend through fastener apertures defined by each of the fore mounting tab 409 of the first spring feature 408 and the aft mounting tab 411 of the second spring feature 410. The fastener apertures are operable to receive a fastener. Referring to FIG. 4, a fore fastener 416 that is located adjacent the front of optical device 404 and an aft fastener 417 that is located adjacent the rear of optical device 404 are utilized to removably attach to the first spring feature 408 and the second spring feature 410 to the optical device 404, respectively.

As an example, the fore fastener 416 and/or the aft fastener 417 may be implemented as a screw, a nail, a threaded member, a bolt, a rivet, or the like. In one example, the fore fastener 416 and the aft fastener 417 are screws that are configured to be received by corresponding threads (not shown) in the fore mounting tab 409 and the aft mounting tab 411 and/or in the optical device 404. In various embodiments, the fore fastener 416 and the aft fastener 417 are snap-fit or snug-fit fasteners and the fastener apertures do not include threads, as would be appreciated by one having ordinary skill in the art upon reading the present disclosure. In various embodiments, the optical device 404 includes fastener receivers that are aligned with the fastener apertures (not shown in FIG. 4 but illustrated by fore fastener aperture 216 and the aft fastener aperture 218 in FIG. 2 and fore fastener aperture 506 and second fastener aperture 514 in FIGS. 5A-5D) of the spring features. Each of the fasteners extends through a corresponding fastener aperture to be secured within the respective fastener receiver located on the optical device 404. Referring to FIGS. 4 and 5A-5D, fore fastener 416 passes through fore fastener aperture 506 illustrated in FIGS. 5A-5D and aft fastener 417 passes through second fastener aperture 514 illustrated in FIGS. 5A-5D.

In other embodiments, the optical device 404 and the first spring feature 408 and the second spring feature 410 are removably coupled using other fastening mechanisms such as magnets, electro-permanent magnets, or the like.

Although FIG. 4 illustrates two fasteners, i.e., fore fastener 416 and aft fastener 417, embodiments of the present invention are not limited to the use of two fasteners and additional fasteners, for example, two fore fasteners utilized in place of fore fastener 416 and two aft fasteners utilized in place of aft fastener 417, can be utilized according to alternative embodiments of the present invention. One of ordinary skill in the art would recognize many variations, modifications, and alternatives.

Figure 5A:
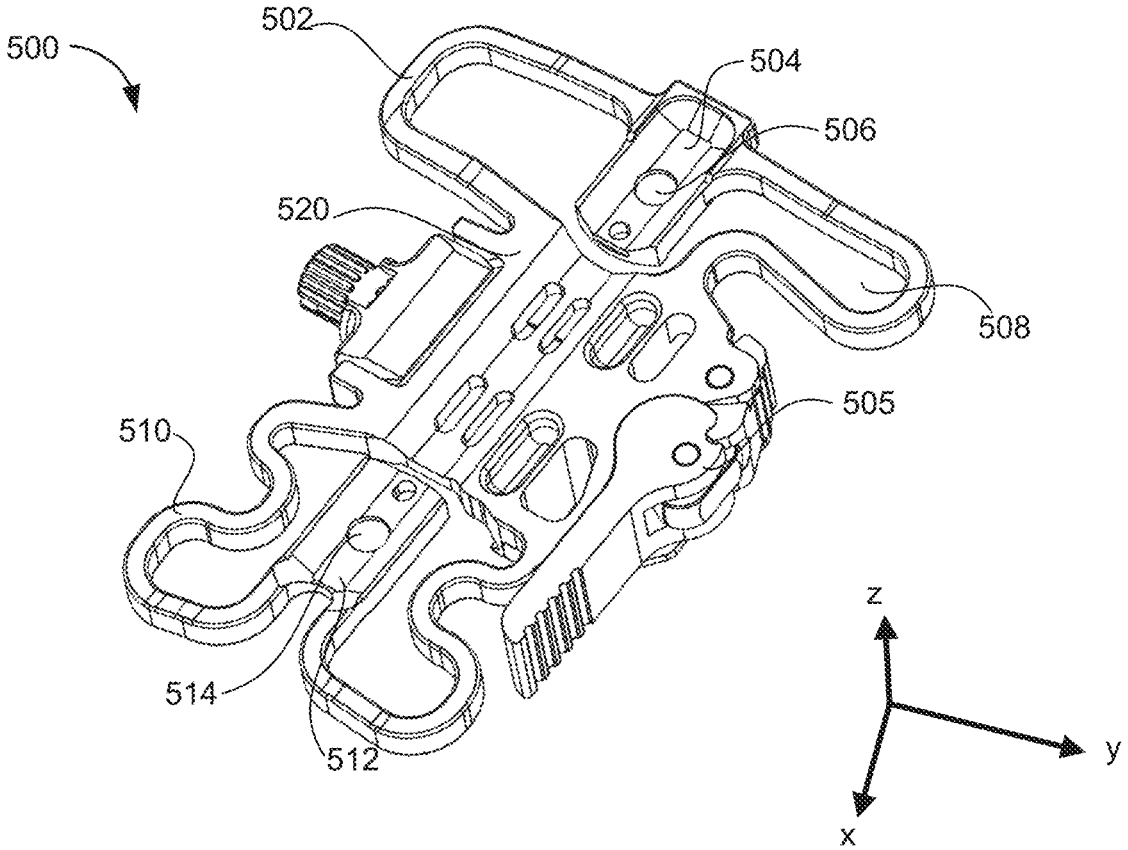
FIG. 5A illustrates a perspective view of an embodiment of an attenuated rail grabber, according to embodiments of the present invention.
Figure 5B:
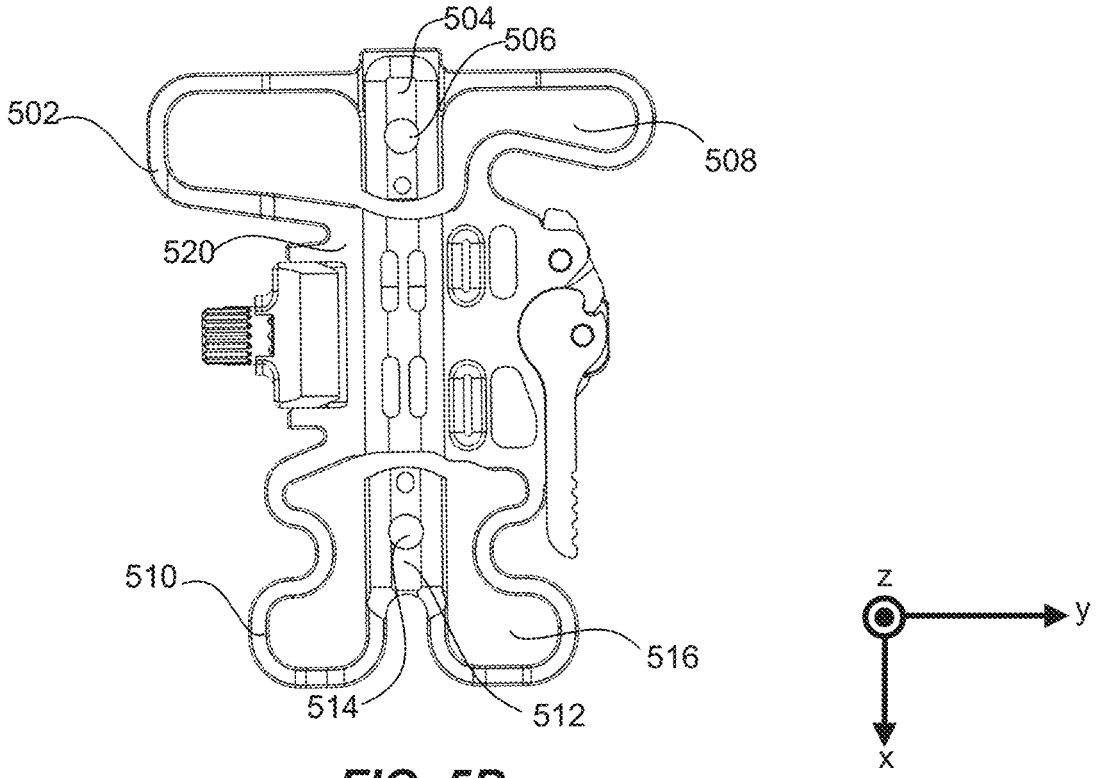
FIG. 5B illustrates a top view of an embodiment of an attenuated rail grabber, according to embodiments of the present invention.
Figure 5C:
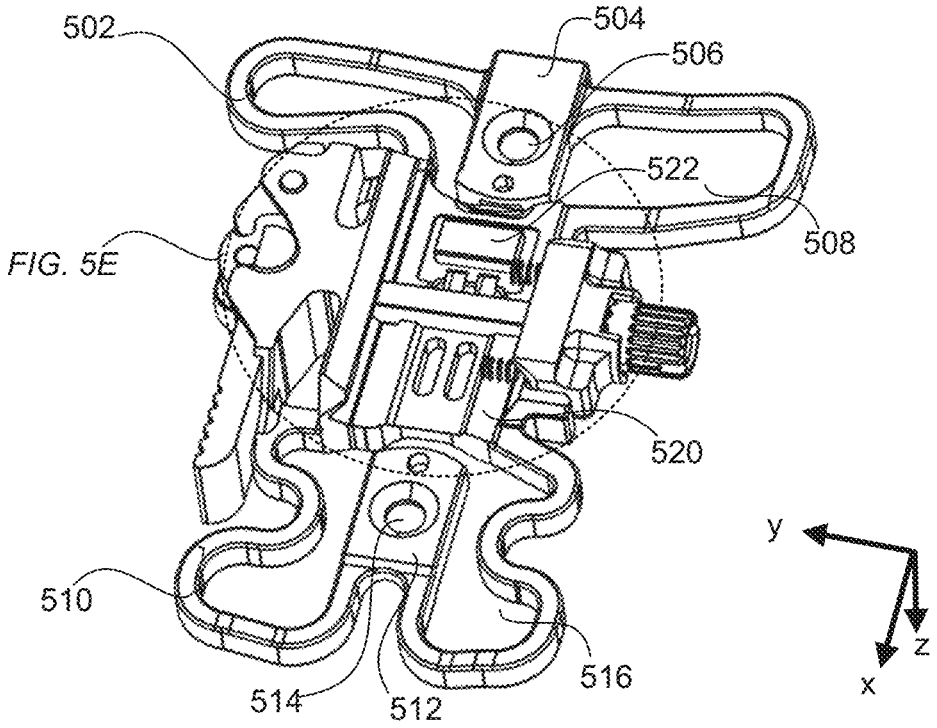
FIG. 5C illustrates a perspective view of an embodiment of an attenuated rail grabber, according to embodiments of the present invention.
Figure 5D:
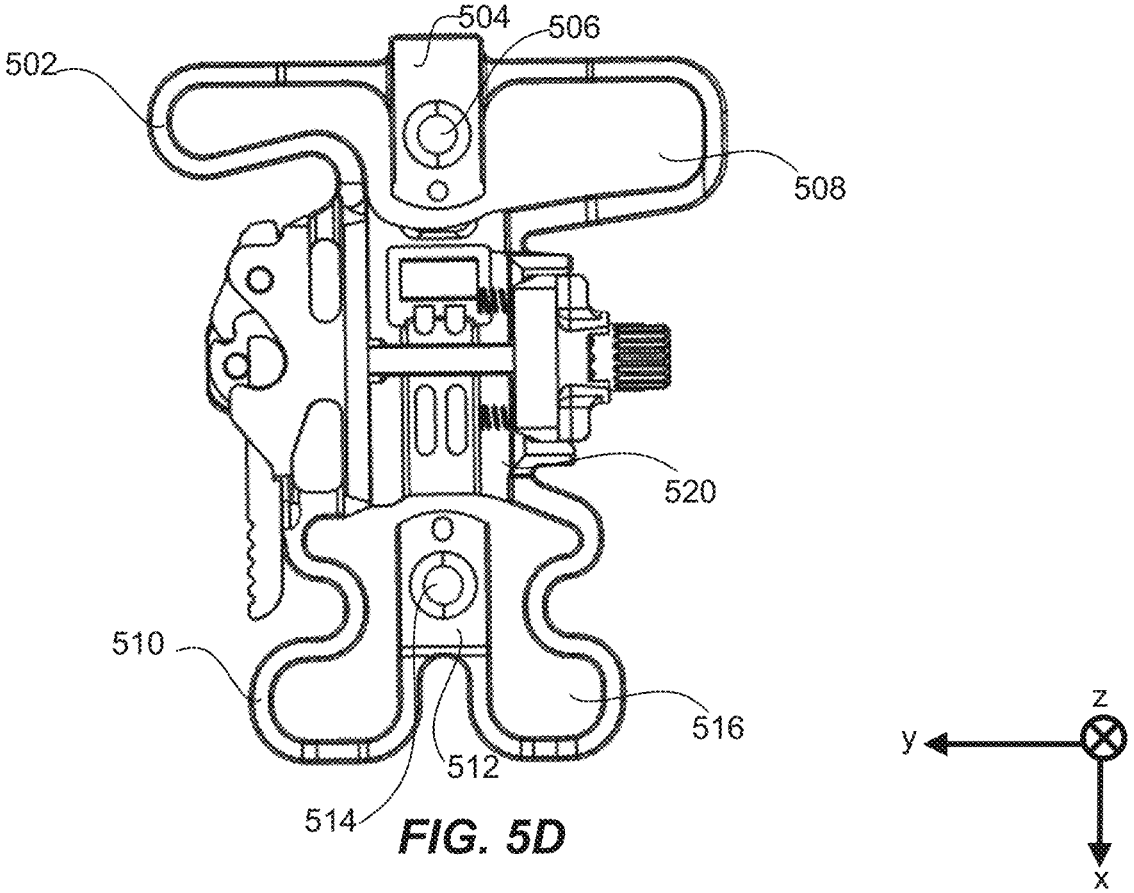
FIG. 5D illustrates a bottom view of an embodiment of an attenuated rail grabber, according to embodiments of the present invention.

FIG. 5A illustrates a perspective view of an embodiment of an attenuated rail grabber, according to embodiments of the present invention. FIG. 5B illustrates a top view of an embodiment of an attenuated rail grabber, according to embodiments of the present invention. FIG. 5C illustrates a perspective view of an embodiment of an attenuated rail grabber, according to embodiments of the present invention. FIG. 5D illustrates a bottom view of an embodiment of an attenuated rail grabber, according to embodiments of the present invention. FIGS. 5A-5D show various embodiments of the attenuated rail grabber used to reduce a weapon's shock to, for example, from 1500 to 400 g's.

The perspective view shown in FIG. 5A is perspective from above and in front of the attenuated rail grabber. As illustrated in FIG. 5A, attenuated rail grabber 500 includes first spring feature 502 extending from a weapon support 520 in a forward direction and second spring feature 510 extending from the weapon support 520 in an aft direction. As previously discussed in relation to FIG. 4, first spring feature 502 includes fore mounting tab 504 having a fore fastener aperture 506 that is configured to receive a fastener that removably attaches fore mounting tab 504 to an optical device. Second spring feature 510 includes an aft mounting tab 512 having a second fastener aperture 514 that is configured to receive a fastener that removably attaches aft mounting tab 512 to the optical device. Thus, fore mounting tab 504 and aft mounting tab 512 are utilized to attach attenuated rail grabber 500 to the optical device.

The weapon support 520 is configured to be attached to an accessory rail of a weapon and/or the weapon using the fastening mechanism 505 illustrated in FIG. 5A. Fastening mechanism 505 illustrated in FIG. 5A is not shown in FIGS. 5B-5D for purposes of clarity. As shown, fastening mechanism includes a clamping lever mechanism although one having ordinary skill in the art upon reading the present disclosure would appreciate that other fastening mechanisms such as a ratchet handles, crank handles, etc., may be used to removably secure the weapon support 520 to an accessory rail of a weapon and/or the weapon.

FIG. 5B illustrates a top view of the attenuated rail grabber according to an embodiment of the present invention. The discussion provided in relation to FIG. 5A is applicable to FIG. 5B as appropriate.

As shown in FIG. 5C, which illustrates the same perspective utilized in FIG. 5A, attenuated rail grabber 500 includes first spring feature 502 extending from a weapon support 520 in a forward direction and second spring feature 510 extending from the weapon support 520 in an aft direction. As previously discussed in relation to FIG. 4, first spring feature 502 includes fore mounting tab 504 having a fore fastener aperture 506 that is configured to receive a fastener that removably attaches fore mounting tab 504 to an optical device. Second spring feature 510 includes an aft mounting tab 512 having a second fastener aperture 514 that is configured to receive a fastener that removably attaches aft mounting tab 512 to the optical device. Thus, fore mounting tab 504 and aft mounting tab 512 are utilized to attach attenuated rail grabber 500 to the optical device.

According to various embodiments and as illustrated by FIGS. 5C and 5D, the attenuated rail grabber 500 includes a projection 522 that extends from the weapon support 520. The attenuated rail grabber 500 may include one or more projections. In some embodiments, the projection 522 does not securely couple to a corresponding indentation on the accessory rail of the weapon and/or the weapon. Rather, the projection 522 may be surrounded by and be loosely encompassed by a corresponding indentation, thereby allowing slight relative movement between the weapon support 520 and the accessory rail of the weapon or the weapon itself. In another embodiment, the projection 522 of the weapon support 520 securely couples to a corresponding indentation of the accessory rail of the weapon or the weapon and does not allow relative movement between the weapon support 520 and the accessory rail of the weapon or the weapon. Although projection 522 is shown as a single rectangular, three-dimensional shape, one having ordinary skill in the art upon reading the present disclosure would appreciate that the projection 522 may be any other three-dimensional shape including a cylinder, a half sphere, a pyramid, etc., to align the attenuated rail grabber 500 to an accessory rail of a weapon and/or to the weapon.

Although FIGS. 5A-5D illustrate a particular shape and configuration of the first spring features 502 and the second spring feature 510, the shape and configuration of the first spring feature 502 and the second spring feature 510 may be adjusted and still fall within the scope of the present invention. For example, the first spring features 502 may include different shapes or the same shape on either side of the longitudinal axis (i.e., the x-axis) of the weapon and/or may be connected to the weapon support 520 at varying distances away from the weapon support 520. In some embodiments, the first spring feature 510 has a first shape and the second spring feature 212 has a second shape where each shape is a geometry defined in the x-y plane. For example, and as shown in FIGS. 5A-5D, the first spring feature 502 has a first shape where the geometry is wider in the y-direction than in the x-direction. Furthermore, the geometry in the y-direction is also wider than the second shape's geometry in the y-direction. In contrast, as shown in FIGS. 5A-5D, the second spring feature 510 has a second shape that is longer in the x-direction than the first shape's geometry in the x-direction. In some embodiments, the first shape and the second shape are different, as shown in FIGS. 5A-5D. In other embodiments, the first shape and the second shape are the same. For example, the first shape and the second shape may be mirrored on opposing sides of the weapon support 520.

Referring once again to first spring features 502, various different configurations of the first spring features 502 are also contemplated. The first spring feature 502 and the second spring feature 510 shown in FIGS. 5A-5D are configured such that they define opening 508 and opening 516, respectively. Specifically, opening 508 is defined by first spring feature 502 and opening 516 is defined by second spring feature 510. Opening 508 extends in the forward direction from the weapon support 520 toward fore mounting tab 504 and opening 516 extends in the aft direction from the weapon support 520 toward the aft mounting tab 512 in the plane of the attenuated rail grabber 500 (i.e., the x-y plane). Opening 508 allows for the first spring feature 502 to move towards and away from the weapon support 520 in the plane of the attenuated rail grabber 500 when a shock or vibration is received at the weapon support 520 of the attenuated rail grabber 500 such that the side of the weapon support 520 adjacent to first spring feature 502 (i.e., the forward side of the weapon support 520) does not make contact with fore mounting tab 504 when weapon support 520 vibrates in response to a shock wave generated by the weapon attached to the weapon support 520. Similarly, opening 516 allows for the second spring feature 510 to move towards and away from the weapon support 520 in the plane of the attenuated rail grabber 500 when a shock or vibration is received at the weapon support 520 of the attenuated rail grabber 500 such that the side of the weapon support 520 adjacent to second spring feature 510 (i.e., the aft side of the weapon support 520) does not make contact with aft mounting tab 512 when weapon support 520 vibrates in response to a shock wave generated by the weapon attached to the weapon support 520.

In other words, the first spring features 502 and opening 508 along with the second spring feature 510 and opening 516 allow for any optical device or other device attached to the fore mounting tab 504 and the aft mounting tab 512 to be substantially or fully physically isolated from the weapon support 520 or any accessory rail on a weapon or other device connected to the weapon support 520.

The opening 508 of the first spring feature 502 and the opening 516 of the second spring feature 510 allow for a reduction of the overall weight of the attenuated rail grabber 500 so that when the attenuated rail grabber 500 is added to the weapon and optical device system, the least amount of weight is added to the system while still reducing the shock experienced by the optical device from 1500 to 400 g's.

In various embodiments described herein, having the weapon support 520 and the first spring feature 502 and the second spring feature 510 in the same plane provides a low-profile attenuated rail grabber system for low frequency and high frequency shock attenuation. Similarly, having the weapon support 520 and the fore mounting tab 504 and the aft mounting tab 512 in the same plane provides a low-profile attenuated rail grabber system for low frequency and high frequency shock attenuation. Accordingly, the attenuated rail grabber, such as any of the embodiments of the attenuated rail grabber described herein, does not add additional height to the weapon/optical device system while improving reliability and decreasing wear to various components of the system.

Figure 5E:
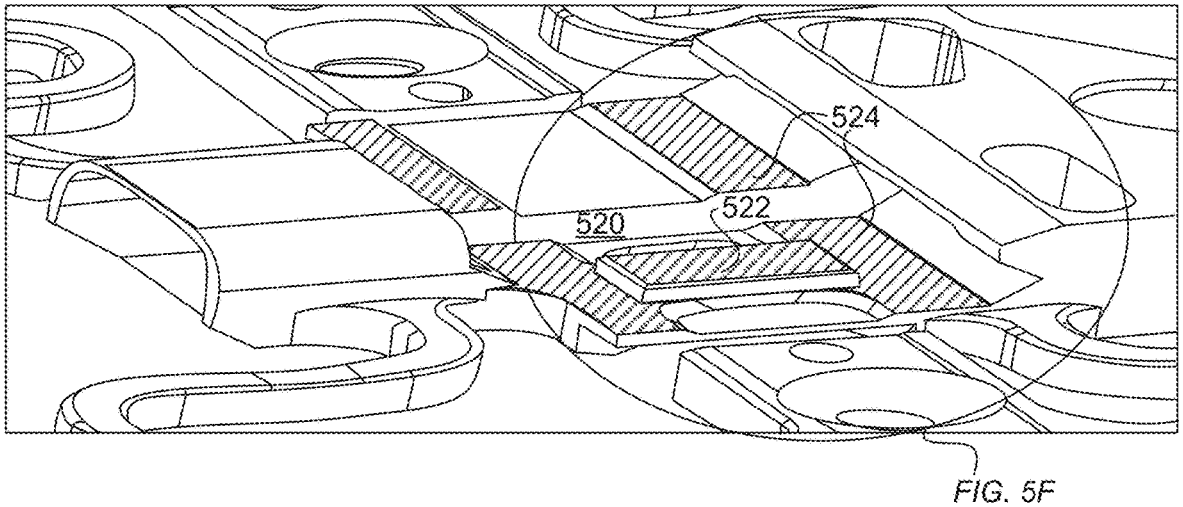
FIG. 5E illustrates a perspective posterior view of an inset of FIG. 5C, according to embodiments of the present invention.

FIG. 5E illustrates a perspective posterior view of an inset of FIG. 5C, according to embodiments of the present invention. As shown in FIG. 5E, a perspective view from a location opposite the forward-facing end of the attenuated rail grabber 500 (e.g., toward the rear facing end and the aft mounting tab 512, not shown) illustrates weapon interfacing surfaces 524 of the attenuated rail grabber 500. Weapon interfacing surfaces 524 minimally contact the accessory rail of the weapon and/or the weapon for facilitating relative movement between the weapon support 520 and the accessory rail of the weapon and/or the weapon. Relative movement enhances shock attenuation by reducing shock transferred between the weapon and the optical device coupled to the attenuated rail grabber 500.

FIG. 5E illustrates projection 522, which extends from the weapon support 520 and interfaces with a corresponding indentation on the accessory rail of the weapon and/or the weapon. The projection 522 may be slightly smaller in size than the corresponding indentation on the accessory rail of the weapon and/or the weapon such that there is relative movement between the weapon support 520 and the accessary rail of the weapon and/or the weapon. In some embodiments, the projection 522 is sized to couple to a corresponding indentation such that there is no relative movement between the weapon support 520 and the accessary rail of the weapon and/or the weapon.

Figure 5F:
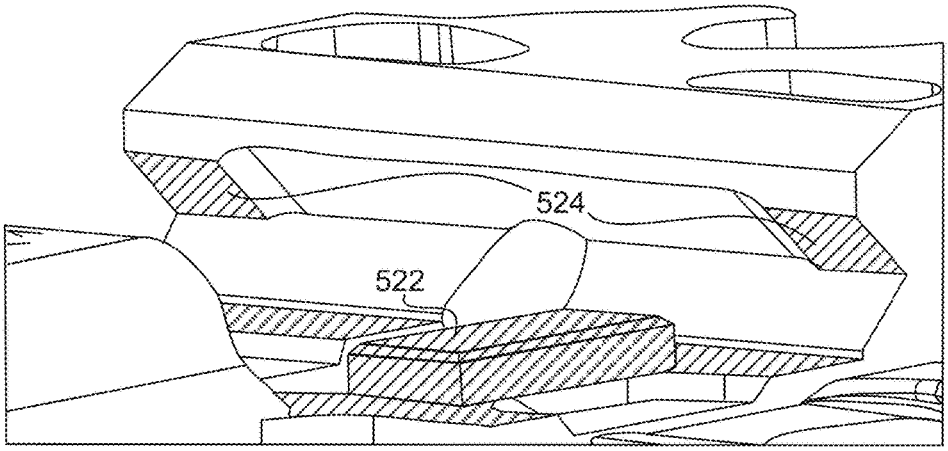
FIG. 5F illustrates a perspective posterior view of an inset of FIG. 5E, according to embodiments of the present invention.

FIG. 5F illustrates a perspective posterior view of an inset of FIG. 5E, according to embodiments of the present invention. As shown in FIG. 5F, a perspective view from a location opposite the forward-facing end of the attenuated rail grabber 500 (e.g., toward the rear facing end and the aft mounting tab 512, not shown) illustrates weapon interfacing surfaces 524 of the attenuated rail grabber 500. Weapon interfacing surfaces 524 minimally contact the accessory rail of the weapon and/or the weapon for facilitating relative movement between the weapon support 520 and the accessory rail of the weapon and/or the weapon. Relative movement enhances shock attenuation by reducing shock transferred between the weapon and the optical device coupled to the attenuated rail grabber 500.

FIG. 5F illustrates projection 522, which extends from the weapon support 520 and interfaces with a corresponding indentation on the accessory rail of the weapon and/or the weapon. The projection 522 may be slightly smaller in size that the corresponding indentation on the accessory rail of the weapon and/or the weapon such that relative movement between the weapon support 520 and the accessary rail of the weapon and/or the weapon. In some embodiments, the projection 522 is sized to couple to a corresponding indentation such that there is no relative movement between the weapon support 520 and the accessary rail of the weapon and/or the weapon.

In various embodiments, an attenuated rail grabber, such as any of the embodiments of the attenuated rail grabber described herein, is provided with a weapon and an optical device. The attenuated rail grabber may be mounted, attached, fastened, etc., to the weapon via a fastening mechanism. The attenuated rail grabber may be mounted, attached, fastened, etc., to the optical device via fasteners provided through corresponding apertures of the attenuated rail grabber and the optical device such that each fastener extends up through the attenuated rail grabber and the optical device for securing the optical device to the attenuated rail grabber. Weapons produce shock in all six degrees of freedom (DOF) which may be summarized as the shock through three primary axes described herein. In at least some embodiments, the weapon generates a shock in a direction or along an axis lateral from the weapon (in other words, along the length of an optical device coupled to the top of the weapon), according to embodiments of the present invention. The shock generated by the weapon may also be in a direction or along an axis vertical from the weapon (in other words, moving up and down towards the top and bottom of the weapon and orthogonal to the barrel of the weapon), according to embodiments of the present invention. The shock generated by the weapon may be in a direction or along an axis lateral from the weapon (in other words, moving out from the sides of the weapon and orthogonal to the barrel of the weapon), according to embodiments of the present invention. In various embodiments, the attenuated rail grabber absorbs at least a portion of the shock by moving spring features of the attenuated rail grabber relative to a rigid support member of the attenuated rail grabber. For example, the spring features may be removably coupled to the optical device and the rigid support member may be removably coupled to the weapon such that the attenuated rail grabber enables relative movement between the spring features and the rigid support member that is absorbed by the spring features, rather than transferred from the weapon to the optical device. As noted, embodiments of the present attenuated rail grabber technology can be mounted between, for example, the weapon and an optical device so as to reduce the shock felt by the optical device from as much as several thousand g's or more down to a predetermined level (for example to below a g loading of 250 g's).

The attenuated rail grabber as described throughout the present disclosure can be manufactured from various materials, including high strength steel, that can allow the shock isolator to withstand very high operating stresses in a relatively compact, lightweight shape. In an embodiment, the material can be a composite, such as carbon fiber, Kevlar, fiberglass, or a combination of these together. In an embodiment, the material may be a metal or metal alloy, such as beryllium copper alloy, stainless steel, nickel, and nickel-copper (e.g., "super alloys"), titanium, titanium alloy, or other high strength alloys. Therefore, such materials are tough and high strength to withstand severe shock received from a weapon during gunfire. According to various embodiments of the present disclosure, the attenuated rail grabber as described herein may be additively manufactured (e.g., 3D printed or the like) and/or subtractively manufactured (e.g., machined or the like).

As noted, embodiments of the present invention relate to a weapon system with an apparatus, such as an attenuated rail grabber, for absorbing shock from a weapon such as a gun (e.g., rifle) to an optical device. Embodiments of the attenuated rail grabber can relate to an optical principle of a clip-on rifle scope that allows the gun/sight system to physically move over small angles without affecting the aim point boresight, as seen through the day view optical scope. The design of the attenuated rail grabber can take advantage of this principle by allowing some physical motion of the system to absorb the bulk of the gunfire shock, providing a level of protection to the optical device. The attenuated rail grabber as described throughout the present disclosure optimizes the amount of physical movement and the attenuated rail grabber's ability to return to the attenuated rail grabber's original position to maintain boresight to the weapon that the attenuated rail grabber is mounted to.

Exemplary weapons that may benefit from embodiments of the present invention are the MK15 .50 caliber, M24, M107, M110, MK13, MK17, MK20, and XM2010 sniper rifles, other rifles, or other guns, for example.

Exemplary sights, including the housing of such sites, can incorporate various other components into the optical sight system, including, for example, output connectors (e.g., video output), a purge valve/screw, an external focus mechanism that is at the rear of the sight, a keypad that is accessible for left and right handed shooters, and an on/off/standby switch that allows position to be determined by touch. One example of the threshold length of the sight can be 9.5" (9.0" objective) and height above rail is 4" (3.5" objective), but the lengths/sizes of such sights may vary.

The technology described and claimed herein is not to be limited in scope by the specific preferred embodiments herein disclosed, since these embodiments are intended as illustrations, and not limitations, of several aspects of the technology. Any equivalent embodiments are intended to be within the scope of this technology. Indeed, various modifications of the technology in addition to those shown and described herein will become apparent to those skilled in the art from the foregoing description. Such modifications are also intended to fall within the scope of the appended claims.

What is claimed is:

1. An attenuated rail grabber comprising: a rigid support member operable to be mounted on a weapon having a longitudinal axis and support an optical device; a fastening mechanism coupled to the rigid support member and operable to fasten the rigid support member to the weapon; a first spring feature coupled to the rigid support member, wherein the first spring feature includes a fore mounting tab having a fore fastener aperture, wherein the fore mounting tab is separated from the rigid support member by a first opening; and a second spring feature coupled to the rigid support member, wherein the second spring feature includes an aft mounting tab having an aft fastener aperture, wherein the aft mounting tab is separated from the rigid support member by a second opening; and wherein the first opening, the second opening, the fore mounting tab, and the aft mounting tab are aligned along the longitudinal axis of the weapon, wherein top surfaces of the rigid support member, first spring feature, and the second spring feature are disposed in the same plane.

2. The attenuated rail grabber of claim 1, wherein the rigid support member is positioned between the weapon and the optical device after mounting.

3. The attenuated rail grabber of claim 1, wherein the attenuated rail grabber is disposed adjacent to the optical device.

4. The attenuated rail grabber of claim 1, wherein the rigid support member is disposed between the first spring feature and the second spring feature.

5. The attenuated rail grabber of claim 1, wherein the rigid support member comprises a projection configured to align with a corresponding indentation on the weapon.

6. The attenuated rail grabber of claim 1, wherein the plane includes the longitudinal axis of the weapon.

7. The attenuated rail grabber of claim 1, wherein the first spring feature and the second spring feature allow for relative movement between the rigid support member and the weapon.

8. The attenuated rail grabber of claim 1, wherein a g load is reduced from 1500 to 400 g's.

9. The attenuated rail grabber of claim 1, wherein the first spring feature has a first shape and the second spring feature has a second shape, wherein the first shape and the second shape are different.

10. The attenuated rail grabber of claim 1, wherein the first spring feature has a first shape and the second spring feature has a second shape, wherein the first shape and the second shape are the same.

11. An attenuated rail grabber operable with a weapon and an optical device, the attenuated rail grabber comprising: a weapon support configured to couple to an accessory rail of the weapon having a longitudinal axis; a first spring feature extending from the weapon support and configured to couple to the optical device, wherein the first spring feature is separated from the weapon support by a first opening; anda second spring feature extending from the weapon support and configured to couple to the optical device, wherein the second spring feature is separated from the weapon support by a second opening, wherein the first opening, the second opening, and the weapon support are aligned along the longitudinal axis of the weapon, wherein top surfaces of the weapon support, the first spring feature, and the second spring feature are disposed in the same plane, and wherein the attenuated rail grabber is configured to reduce shock experienced by the optical device by a predetermined g load.

12. The attenuated rail grabber of claim 11, wherein the first spring feature has a first shape and the second spring feature has a second shape, wherein the first shape and the second shape are different.

13. The attenuated rail grabber of claim 11, wherein the weapon support is positioned between the weapon and the optical device after mounting.

14. The attenuated rail grabber of claim 11, wherein the attenuated rail grabber is disposed adjacent to the optical device.

15. The attenuated rail grabber of claim 11, wherein the weapon support is disposed between the first spring feature and the second spring feature.

16. The attenuated rail grabber of claim 11, wherein the weapon support comprises a projection configured to align with a corresponding indentation on the weapon.

17. The attenuated rail grabber of claim 11, wherein the first spring feature has a first shape and the second spring feature are has a second shape, wherein the first shape and the second shape are the same.

18. The attenuated rail grabber of claim 11, wherein the plane includes the longitudinal axis of the weapon.

19. The attenuated rail grabber of claim 11, wherein the first spring feature and the second spring feature allow for relative movement between the weapon support and the weapon.

20. The attenuated rail grabber of claim 11, wherein the predetermined g load is reduced from 1500 to 400 g's.

* * * * *